United States Patent [19]

Spamer

[11] 4,300,693

[45] Nov. 17, 1981

[54] AUTOMATIC FEED DEVICE FOR MERCHANDISE DISPLAY

[75] Inventor: William S. Spamer, Roswell, Ga.

[73] Assignee: The Mead Corporation, Dayton, Ohio

[21] Appl. No.: 94,635

[22] Filed: Nov. 15, 1979

[51] Int. Cl.[3] ..... A47F 1/00

[52] U.S. Cl. ..... 211/49 D

[58] Field of Search ..... 211/49 D, 51, 43; 312/71

[56] References Cited

U.S. PATENT DOCUMENTS

| | | | |
|---|---|---|---|
| 2,738,881 | 3/1956 | Michel | 211/49 D |
| 2,934,312 | 4/1960 | Jacobson | 211/49 D |
| 2,944,672 | 7/1960 | Simpson | 211/49 D |
| 3,161,295 | 12/1964 | Chesley | 211/49 D |
| 3,308,961 | 3/1967 | Chesley | 211/49 D |
| 4,136,802 | 1/1979 | Mascia et al. | 312/71 X |

*Primary Examiner*—Roy D. Frazier
*Assistant Examiner*—Robert W. Gibson, Jr.
*Attorney, Agent, or Firm*—Erwin Doerr

[57] ABSTRACT

An automatic feed device (10) for a merchandise display rack has a feed assembly (18) powered for the duration of its travel by a primary spring (16) to move articles along a track (11) and includes a secondary spring (17) to augment the spring force exerted on the feed assembly (18) only during an initial part of its travel, thereby producing a feed having a low uniform speed.

8 Claims, 4 Drawing Figures

AUTOMATIC FEED DEVICE FOR MERCHANDISE DISPLAY

This invention relates to an automatic article feed device for feeding a row of articles such as bottles, packages and cans. The device is particularly useful in combination with a merchandise display rack where it is desirable that articles for sale are advanced forwardly of the rack so that they are always in view of, and readily accessible to, the customer. Automatic feed devices incorporating a spring loaded feed assembly are well known in the art. However, a disadvantage common to many of the known devices is that the spring force is chosen so that the feed assembly is operative when the device is fully loaded resulting in a situation in which excess spring force is exerted on the feed assembly when the load is reduced, i.e. when articles are removed from the device. Consequently, as the device becomes unloaded, in use, the remaining articles are advanced at too high a speed.

One attempt at overcoming this disadvantage involved the use of powering the feed assembly by a constant ratio spring, which is a spring whose force remains in a constant ratio with respect to the load on which it acts. Such a spring therefore is expected to exhibit a reduction in power exerted on the feed assembly as the articles are unloaded from the device. However, in practice it has been found that these springs merely approximate to the constant ratio characteristic and are prone to 'flat-spots' resulting in erratic movement of the feed assembly.

The present invention overcomes this problem by utilizing a primary spring by which the feed assembly is powered for the duration of its travel and a secondary spring to augment the force exerted on the feed assembly only during that time in which it is most heavily loaded. This results in a smooth, substantially constant low velocity movement of the feed assembly over the duration of its travel.

The invention provides in an automatic article feed device having a spring loaded feed assembly powered for the duration of its travel by a primary spring to move articles along a track, a secondary spring to augment the spring force exerted on the feed assembly during an initial part of its travel whereafter the feed assembly is powered solely by the primary spring.

Preferably, both the primary and the secondary springs are constant ratio springs.

Figure 1:
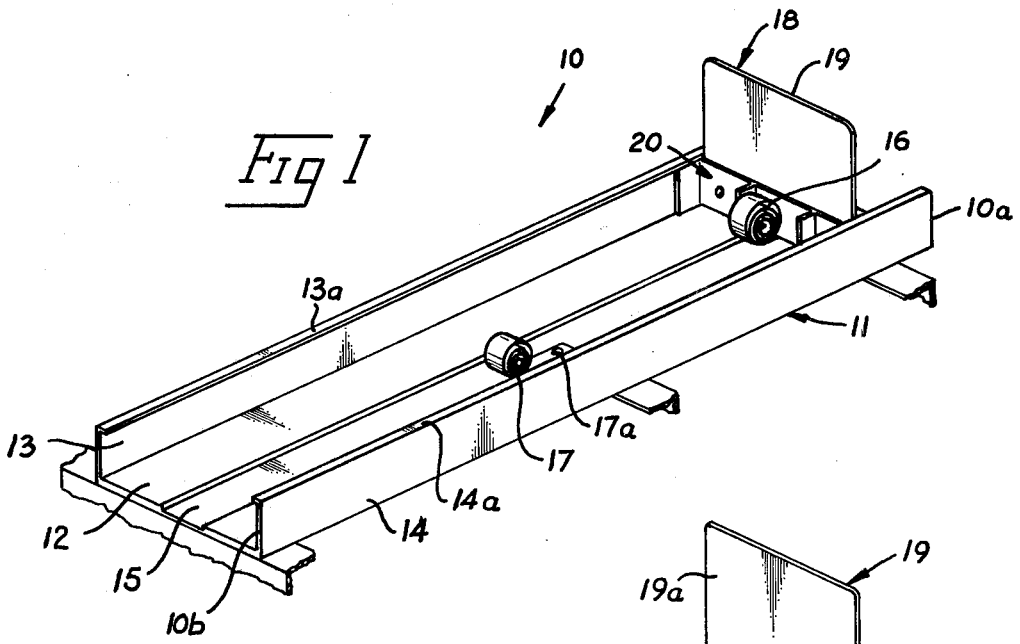
Figure 2:
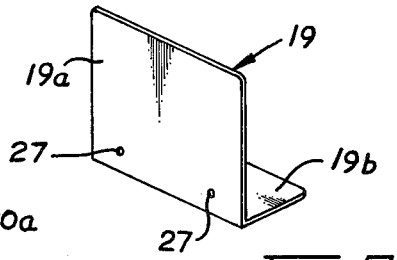
Figure 3:
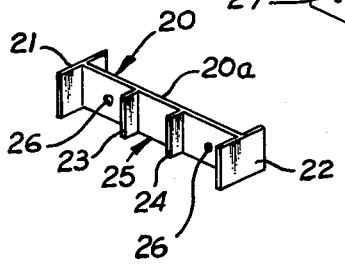
Figure 4:
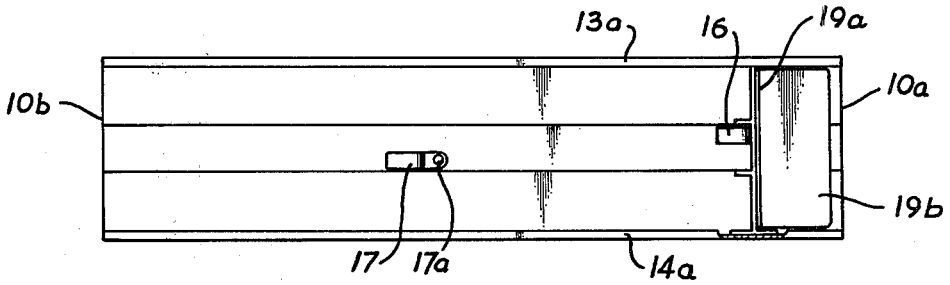

In the following description a preferred embodiment of the invention is described in detail in conjuncton with the accompanying drawings, in which:

FIG. 1 is a perspective view of an automatic feed device for use in a merchandise display rack, FIG. 2 is a perspective view of a pusher plate comprising a part of the feed assembly of the device, FIG. 3 is a perspective view of a guide bar also comprising a part of the feed assemlby of the device, and FIG. 4 is a plan view of the device illustrated in FIG. 1.

Referring to the drawings, there is shown an automatic feed device 10 for use in a merchandise display rack to forward feed a row of articles such as bottles, cans and packages. The device comprises a track 11 including a base 12 connecting together a pair of spaced side walls 13, 14 respectively. The track 11 is formed from a plastics material e.g. by extrusion but other suitable materials such as metal also may be used.

Extending along the length of the base 12 is formed a central channel section groove 15 in which is mounted a pair of coiled strips, constant ratio springs; a primary spring 16 and a secondary spring 17. Both springs are mounted by passing a rivet, as at 17*a*, or other appropriate fastener through one end of the strip and through the bottom of the groove 15. Primary spring 16 is connected to the base adjacent the delivery end 10*a* of the track and secondary spring 17 is connected to the base approximately halfway between the delivery end 10*a* and the back end 10*b* of the track. The delivery end 10*a* of the track is that which is presented to the front of a merchandise display rack when the feed device 10 is loaded therein with the back end 10*b* disposed at the rear of the rack. Normally, the automatic feed device 10 is incorporated in a merchandise display rack such that the track 11 slopes forwardly from the back end 10*b* towrds the front end 10*a*. Usually, it would be desirable to have a plurality of such devices mounted in side by side relationship. However, the device 10 may be mounted horizontally if required with appropriate adjustment in the spring force.

The device 10 further includes a plastics or metal feed assembly 18 comprising a pusher plate 19 shown in FIG. 2 and a guide bar 20 shown in FIG. 3. The pusher plate 19 consists of an 'L'-shaped bracket having limbs 19*a*, 19*b* respectively. The guide bar comprises an elongate body portion 20*a* terminating in integral side flanges 21, 22 respectively which are each of the same depth as the body portion 20*a*. The body portion carries a pair of spaced fins 23, 24 intermediate its side flanges which define between them a recess 25. The pusher plate 19 is sized to be received between the side flanges 21, 22 of the guide bar 20 and the pusher plate and guide bar are held connected together by means of suitable fasteners which pass through registering apertures 26, 27 provided in the body portion 20*a* of the guide bar and limb 19*a* of the pusher plate, respectively.

The feed assembly 18 is received on the track base 12 such that the limb 19*b* of the pusher plate overlies the base 12 and the side flanges 21, 22 slidingly engage the track walls 13, 14 respectively. The side flanges are of the same height as walls 13, 14 and the top edge of each wall is formed with a longitudinally extending lip 13*a*, 14*a* respectively.

As can best be seen in the sectioned portion in FIG. 4, the lips 13*a*, 14*a* overlie the side flanges 21, 22 and thereby retain the guide bar from vertical movement away from the track base.

FIG. 1 shows the device in its unloaded condition i.e. there are no articles on the track 11 and the feed assembly 18 is disposed at the end of its travel adjacent the delivery end 10*a* of the track. In this condition both springs 16 and 17 are in their unrestrained condition so that they are coiled up on themselves as best seen in FIG. 1. When the feed device 10 is loaded the feed assembly 18 is retracted to the back end 10*b* of the track thereby causing springs 16, 17 to uncoil into a flat strip lying in the groove 15 flush with the top surface of the base 12. As is apparent from both FIGS. 1 and 4 the primary spring 16 is located adjacent the left-hand wall of groove 15 and the secondary spring is located adjacent the right-hand wall of groove 15 so that when the feed assembly 19 is fully retracted in its loaded state both springs 16, 17 are located in side by side relationship in recess 25.

Articles to be fed are aligned in a row on the track base with the rearmost article resting on limb 19*b* of the pusher plate 19. Hence, when the foremost article at the delivery end 10*a* is removed for purchase by a customer, both springs in attempting to attain their unrestrained condition urge the feed assembly 18 forward thus bringing the next succeeding article to the delivery end 10*a* of the track.

As unloading of the device continues the feed assembly 18 moves along the track and as the feed assembly passes the fixture point of secondary spring 17, secondary spring 17 is completely coiled and therefore exerts no further force against the feed assembly 18.

Further unloading causes the feed assembly to be moved forward for the remainder of its travel powered solely by the primary spring 16. Hence, the feed assembly 18 is subjected to the greatest spring force during the initial part of its travel when the load is at its greatest and thereafter is subjected to a lower spring force as the load is reduced. This arrangement makes for a smoothly operating device in which the feed assembly is advanced at a low, uniform speed.

I claim:

1. An automatic article feed device having a spring loaded feed assembly powered for the duration of its travel by a primary spring to move articles along a track and comprising a secondary spring to augment the spring force exerted on the feed assembly during an initial part of its travel whereafter the feed assembly is powered solely by the primary spring, said primary and secondary springs forming coiled strips when unrestrained and each spring being mounted to propel the feed assembly whilst that spring is seeking to establish its unrestrained condition, characterized in that said primary and secondary springs are mounted on the track at longitudinally spaced locations to push the feed assembly along the track.

2. A device according to claim 1 wherein the force exerted by each of the primary and secondary springs is in a substantially constant ratio with respect to the load on which the feed assembly acts.

3. An automatic article feed device comprising:

(a) a track having a back end and a delivery end;

(b) a spring loaded feed assembly mounted for travel from said back end to said delivery end of the track to move articles towards said delivery end of the track; and (c) a primary spring mounted adjacent said delivery end of the track and a secondary spring mounted parallel to said primary spring intermediate said back end and said delivery end of the track; said feed assembly being powered during an initial part of its travel by both said primary and said secondary springs, whereafter the feed assembly is powered for the remainder of its travel solely by said primary spring.

4. A device according to claim 3 wherein the track comprises a base interconnecting a pair of side walls with a longitudinal groove formed in the base of the track.

5. A device according to claim 4 wherein the primary and secondary springs are both mounted in said longitudinal groove.

6. A device according to claim 4 wherein the feed assembly comprises a pusher plate and a guide bar which bar extends transversely of the track and terminates in side flanges which locate against respective side walls of the track and wherein each side wall includes a longitudinal retaining lip for co-operation with one of the side flanges to hold the guide bar together with said pusher plate within the track.

7. A device according to claim 6 wherein the primary and secondary springs are coiled strips and the guide bar includes means defining a recess in which the coiled ends of said primary and secondary springs locate in side by side relationship when acting on the feed assembly.

8. A merchandise display rack incorporating at least one automatic article feed device, each device comprising:

(a) a track having a back end and a delivery end and mounted in the rack at an incline such that the track slopes downwardly towards said delivery end;

(b) a spring loaded feed assembly mounted for travel from said back end to said delivery end of the track to move articles towards said delivery end of the track;

(c) a primary spring mounted adjacent said delivery end of the track and a secondary spring intermediate said back end and said delivery end of the track; and (d) stop means provided at said delivery end of the track to limit forward feed of articles disposed in the track; said feed assembly being powered during an initial part of its travel by both said primary and said secondary springs, whereafter the feed assembly is powered for the remainder of its travel solely by said primary spring.

* * * * *